US008701561B2

(12) United States Patent
Miller et al.

(10) Patent No.: US 8,701,561 B2
(45) Date of Patent: Apr. 22, 2014

(54) PROJECTILE THAT INCLUDES A SENSOR TO OBTAIN ENVIRONMENTAL DATA DURING LAUNCH FROM A CANNON

(75) Inventors: Shawn A. Miller, Oro Valley, AZ (US); Mark A. Scott, Corona, AZ (US); Douglas J. Eliason, Saint David, AZ (US); Kevin R. Greenwood, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 345 days.

(21) Appl. No.: 13/222,508

(22) Filed: Aug. 31, 2011

(65) Prior Publication Data

US 2012/0312092 A1 Dec. 13, 2012

Related U.S. Application Data

(60) Provisional application No. 61/382,325, filed on Sep. 13, 2010.

(51) Int. Cl.
*F42B 30/08* (2006.01)
*G01L 5/14* (2006.01)

(52) U.S. Cl.
USPC ..... 102/520; 73/167

(58) Field of Classification Search
USPC ..... 73/862.381, 862.53; 102/501–529
See application file for complete search history.

(56) References Cited

U.S. PATENT DOCUMENTS 1,489,566 A * 4/1924 Webster, Jr. et al. ..... 73/167
2,475,387 A * 7/1949 Golden ..... 73/167
2,993,444 A * 7/1961 Hablutzel ..... 102/523
2,998,778 A * 9/1961 Hablutzel ..... 102/522
3,143,154 A * 8/1964 Best ..... 150/154
3,338,134 A * 8/1967 Barnes ..... 89/1.808
3,999,486 A * 12/1976 Bower ..... 102/526
4,327,643 A * 5/1982 Lasheras Barrios ..... 102/493
4,382,411 A * 5/1983 Ambrosini ..... 102/523
4,649,796 A * 3/1987 Schmidt ..... 89/6.5

(Continued)

FOREIGN PATENT DOCUMENTS

DE 102008017437 A1 * 10/2009 ..... F42B 14/06
WO WO-2011/119733 A2 9/2011
WO WO-2012/036921 A1 3/2012

OTHER PUBLICATIONS

"Clamping Study", Sensor Products, Inc., archived by the Internet Archive on Aug. 20, 2008.*

(Continued)

*Primary Examiner* — David A Rogers
(74) *Attorney, Agent, or Firm* — Schwegman, Lundberg & Woessner, P.A.

(57) ABSTRACT

Some embodiments pertain to a projectile that includes a casing and a sensor that is wrapped around the casing. As an example, the sensor may be wrapped around a longitudinal axis of the casing. The sensor obtains environmental data that the projectile is exposed to when the projectile is inside a cannon tube. As an example, the sensor may obtain pressure data that the projectile is exposed to during launch of the projectile when the projectile is inside the cannon tube. The sensor may include a plurality of segments that at least partially surround the casing. In some embodiments, the segments may be separated from the casing due to pressure that the projectile is exposed to during launch.

13 Claims, 8 Drawing Sheets
(2 of 8 Drawing Sheet(s) Filed in Color)

(56) References Cited

U.S. PATENT DOCUMENTS

| | | | | |
|---|---|---|---|---|
| 5,243,896 | A * | 9/1993 | Rodriguez | 89/40.07 |
| 5,705,766 | A * | 1/1998 | Farace et al. | 102/215 |
| 6,233,374 | B1 | 5/2001 | Ogle et al. | |
| 6,378,437 | B1 | 4/2002 | Burke, Jr. et al. | |
| 7,568,430 | B1 | 8/2009 | Conley et al. | |
| 7,600,421 | B1 | 10/2009 | Hollis et al. | |
| 7,603,951 | B2 | 10/2009 | Rose et al. | |
| 7,793,888 | B2 * | 9/2010 | Padan | 244/137.4 |
| 8,109,213 | B1 * | 2/2012 | Poulos et al. | 102/524 |
| 2004/0226386 | A1 | 11/2004 | Gysling et al. | |
| 2005/0016413 | A1 * | 1/2005 | Eches et al. | 102/521 |
| 2005/0188891 | A1 * | 9/2005 | Heitmann et al. | 102/523 |
| 2006/0202088 | A1 * | 9/2006 | Padan | 244/137.1 |
| 2008/0257192 | A1 * | 10/2008 | Schaeffer | 102/438 |
| 2009/0205908 | A1 * | 8/2009 | Hammonds | 187/222 |
| 2010/0263526 | A1 * | 10/2010 | Heldmann | 89/37.01 |
| 2010/0326198 | A1 * | 12/2010 | Ribi | 73/700 |

OTHER PUBLICATIONS

Pressure Distribution Mapping System FPD-8010E, FujiFilm. archived by the Internet Archive on Sep. 10, 2009.*

Wetz et al., "Electromagnetic Launch to Space", Proceedings of the 2nd Euro-Asian Pulsed Power Conference, Sep. 22-26, 2008.*

"International Application Serial No. PCT/US2011/050341, Int. Search Report mailed Feb. 22, 2012", 3 pgs.

International Application Serial No. PCT/US2011/050341, Written Opinion mailed Feb. 22, 2012, 8 pgs.

"International Application Serial No. PCT/US2011/050341, International Preliminary Report on Patentability mailed Mar. 28, 2013", 7 pgs.

* cited by examiner

PROJECTILE THAT INCLUDES A SENSOR TO OBTAIN ENVIRONMENTAL DATA DURING LAUNCH FROM A CANNON

CLAIM OF PRIORITY

This patent application claims priority under 35 U.S.C. 119 to U.S. Provisional Patent Application Ser. No. 61/382,325, filed Sep. 13, 2010, the contents of which are incorporated herein by reference in its entirety.

TECHNICAL FIELD

Embodiments pertain to a projectile, and more particularly to a projectile that exposed to extreme environments during launch from a cannon.

BACKGROUND

Projectiles are typically subjected to an extreme environment (15,000 g's and 20,000-60,000 psi) as they are launched from a cannon. As an example, "blow-by pressure" builds up along the side of the projectile. This pressure build-up often causes structural damage to the projectile which can be a critical safety concern. Therefore, the effects of the pressure build-up are usually addressed during development of the projectile by conducting tests to determine the pressure that the projectile is exposed to during launch.

One approach to conducting such pressure tests is by collecting data from pressure taps that are typically inserted into the side of the cannon tube. These pressure taps often cause damage to the cannon tube while providing discrete points of reference to establish a pressure profile from the perspective of the cannon tube. These single points of reference are analyzed and estimates are made to create corresponding pressure profile curves. These pressure profile curves usually do not provide enough accurate detail to properly characterize the blow-by pressure seen along the projectile body.

Another approach to conducting such pressure tests utilizes pressure sensors positioned within the projectile at discrete locations around the projectile. Positioning pressure sensors around the projectile in this manner provides data regarding blow-by pressure on the projectile. However, there is no correlation as to where the sensors are located on the instrumented projectile and where the maximum pressure is exerted on the projectile.

In addition, there are usually limitations associated with calibrating these types of sensors. As an example, these types of sensors typically need to be permanently embedded within the projectiles in order to allow the sensors to survive the extreme environments that they are exposed to during launch.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION

The following description and the drawings sufficiently illustrate specific embodiments to enable those skilled in the art to practice them. Other embodiments may incorporate structural, logical, electrical, process, and other changes. Portions and features of some embodiments may be included in, or substituted for, those of other embodiments. Embodiments set forth in the claims encompass all available equivalents of those claims.

As used herein, projectile refers to missiles, guided projectiles, unguided projectiles and sub-munitions.

Figure 1:
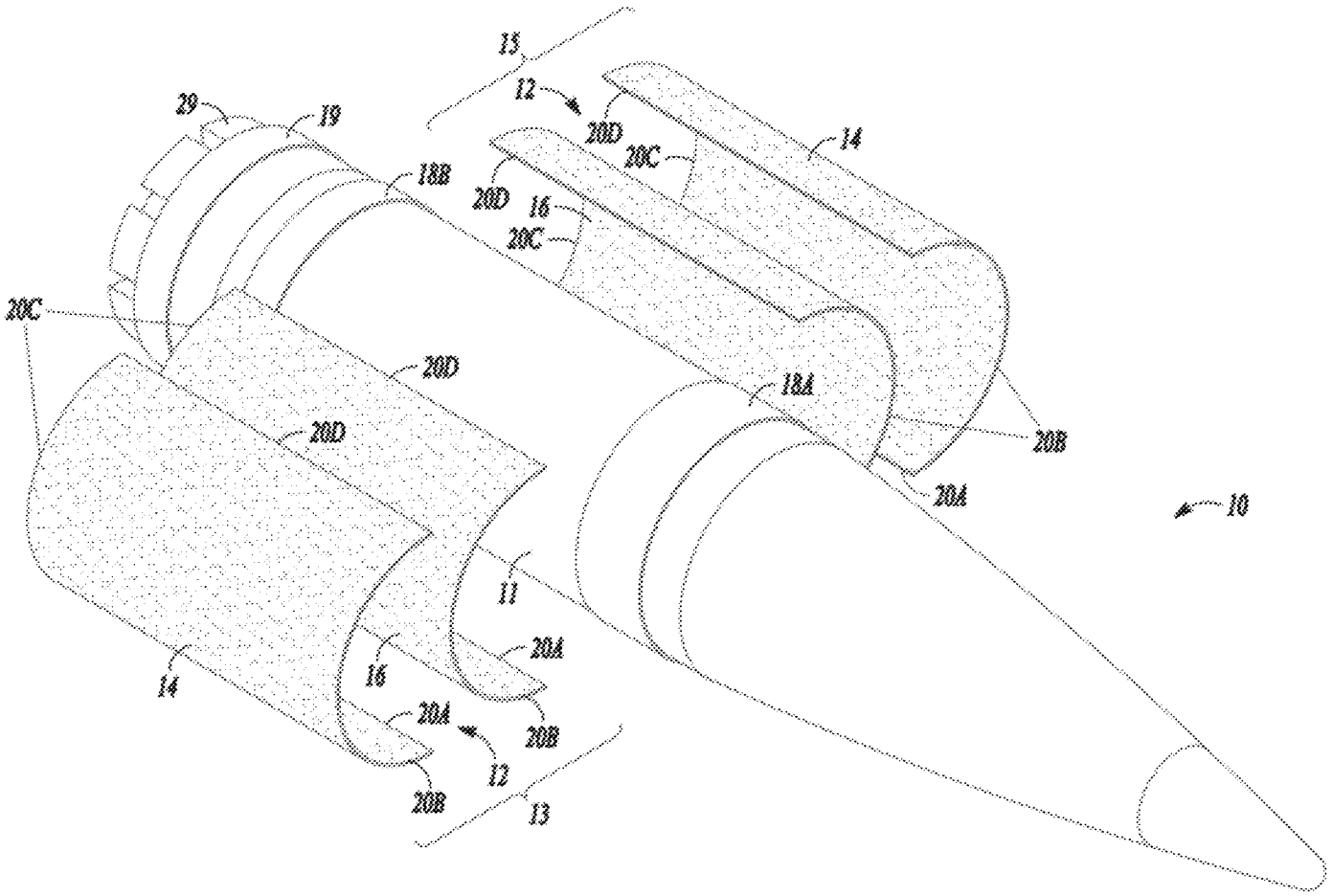
FIG. 1 is a perspective view of an example projectile.
Figure 2:
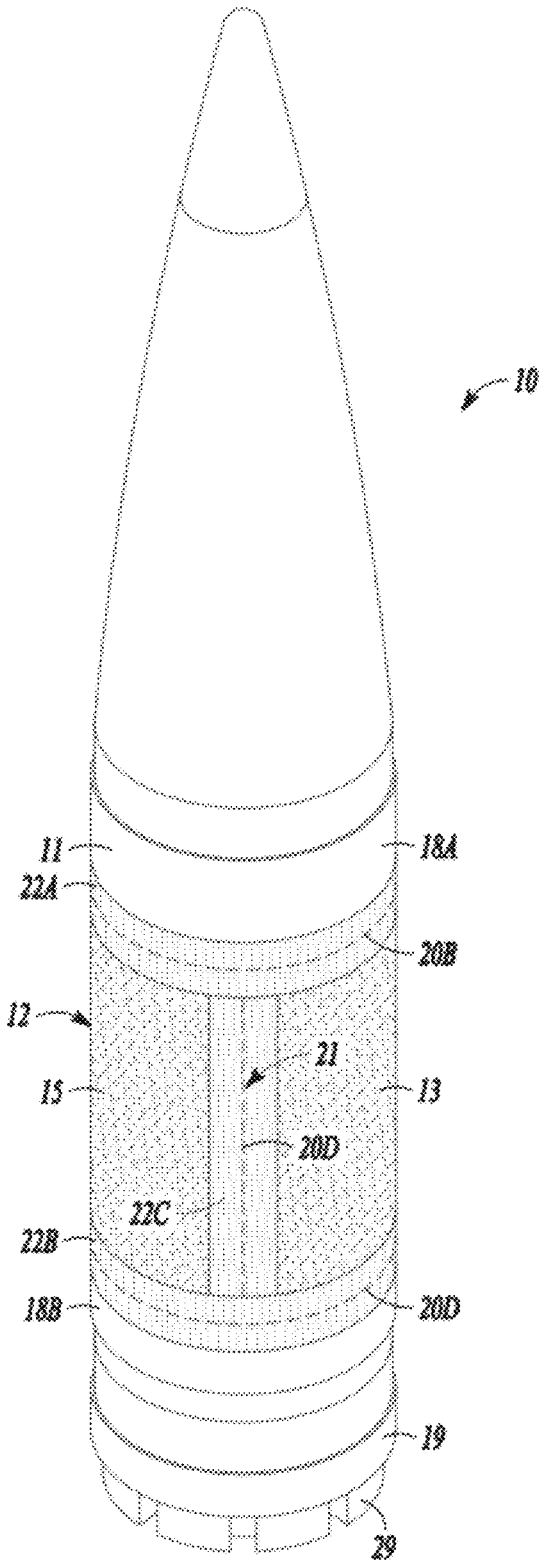
FIG. 2 is an enlarged front view of the projectile shown in FIG. 1.

FIGS. 1 and 2 illustrate an example projectile 10. The projectile 10 includes a casing 11 and a sensor 12 that is wrapped around the casing 11. In the example embodiment that is illustrated in FIGS. 1 and 2, the sensor 12 is wrapped around a longitudinal axis of the casing 11.

The sensor 12 obtains environmental data that the projectile 10 is exposed to when the projectile 10 is inside a cannon tube (not shown in FIGS. 1 and 2). The sensor 12 obtains environmental data that the projectile 10 is exposed to inside the cannon tube during (i) launch of the projectile 10; and/or (ii) loading of the projectile 10. As an example, the sensor 12 may obtain pressure data that the projectile 10 is exposed to when the projectile 10 is inside the cannon tube.

Figure 3:
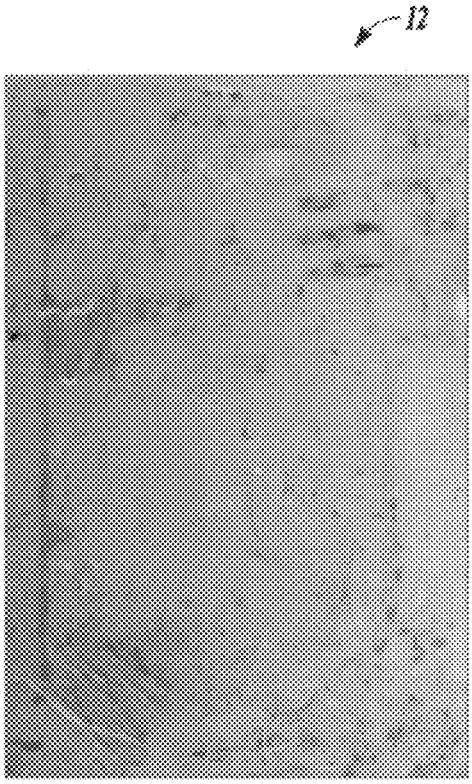
FIG. 3 illustrates an example sensor sheet that may be used in the projectile shown in FIGS. 1 and 2 after post firing recovery.

In one example embodiment, the sensor measures blow-by pressures within a cannon. The sensor 12 may utilize a pressure sensitive material to sense (i.e., imprint) the maximum pressure onto a film for post firing data analysis. Although different types of pressure sensitive films may be used, FIG. 3 shows one example film, which is a PressureX tactile pressure indicating sensor film. As an example, blow-by pressure mapping may be done by evaluating the pressure film with an optical scanner and running a data conversion analysis using specialized software in order to prepare a 360 degree pressure map of the pressure that the projectile 10 is exposed to during launch from a cannon tube.

Figure 4:
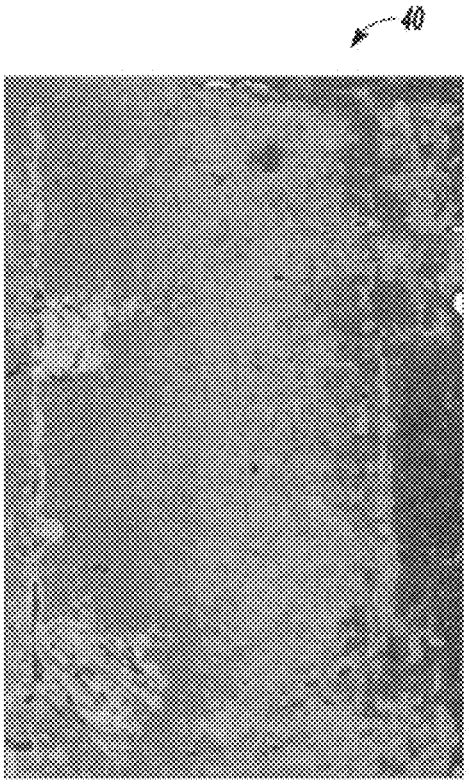
FIG. 4 illustrates the sensor sheet of FIG. 3 after performing an optical scan of the sensor sheet.
Figure 5:
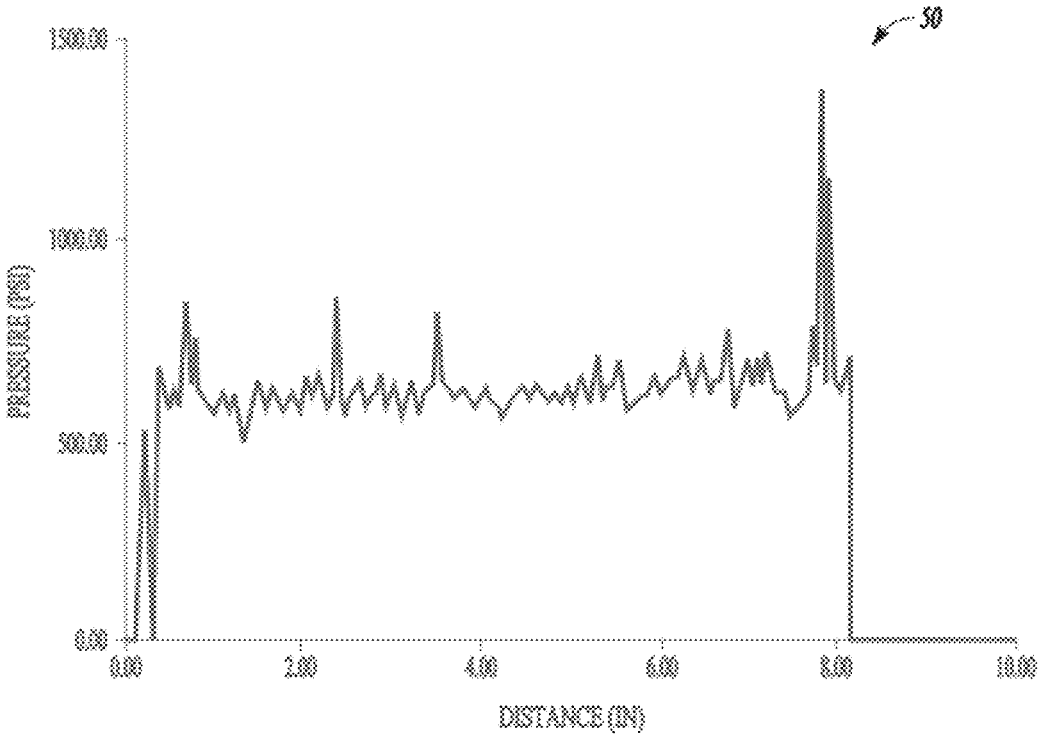
FIG. 5 illustrates an example line scan of the sensor sheet shown in FIG. 4.
Figure 6:
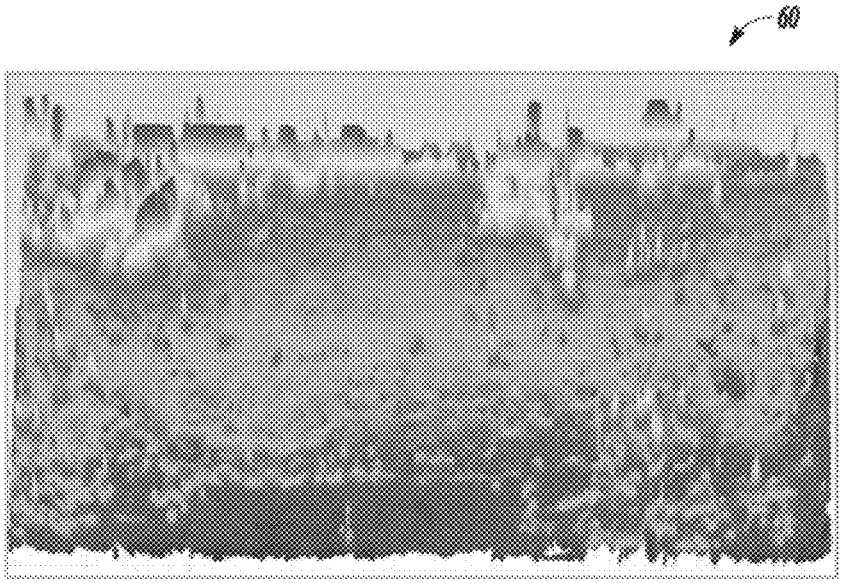
FIG. 6 illustrates example sensor sheet data for the sensor sheet shown in FIG. 3 in a three dimensional format.
Figure 7:
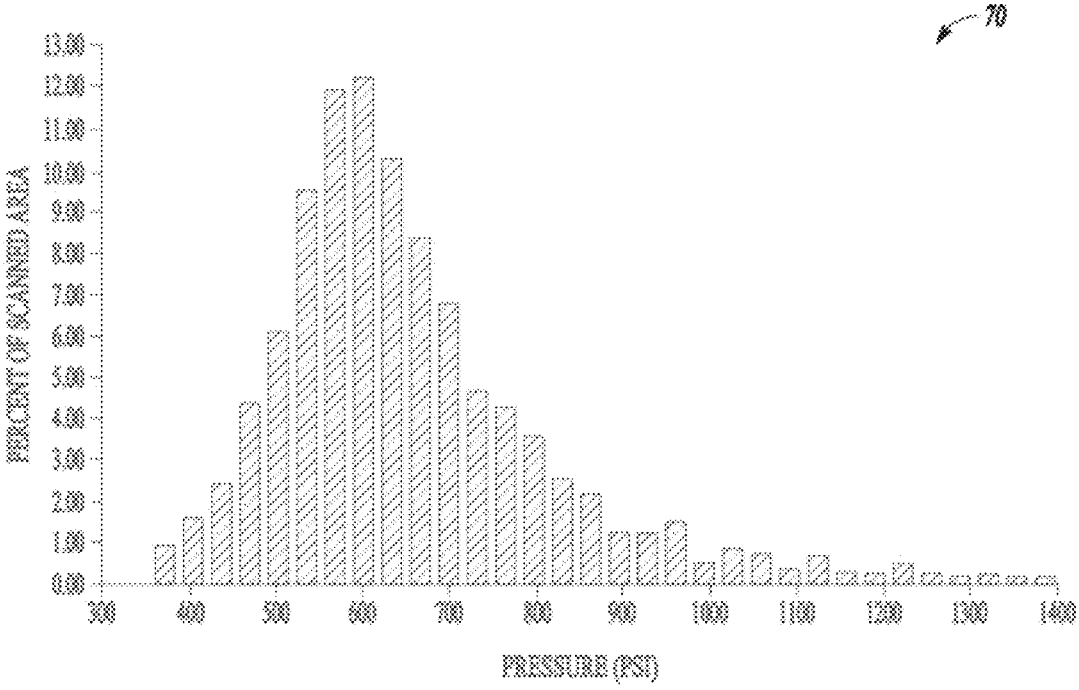
FIG. 7 illustrates example sensor data distribution in a histogram format.

FIG. 4 illustrates the sensor sheet of FIG. 3 after performing an optical scan 40 of the sensor sheet. FIG. 5 illustrates an example line scan 50 of the sensor sheet shown in FIG. 4. FIG. 6 illustrates example sensor sheet data 60 for the sensor sheet shown in FIG. 3 in a three dimensional format. FIG. 7 illustrates example sensor data distribution 70 in a histogram format.

In the example embodiment that is illustrated in FIGS. 1 and 2, the casing 11 includes an obturator 19 such that the sensor 12 is positioned near the obturator 19. In some embodiments, the casing 11 includes a tail section 29 such that the sensor 12 and the tail section 29 are on opposing side of the obturator 19.

The casing 11 may also include a first bourrelet 18A and a second bourrelet 18B such that the sensor 12 is located between the first and second bourrelets 18A, 18B. In other embodiments, the sensor 12 may be located on a bourrelet to measure impact data with the casing 11.

It should be noted that the sensor 12 may take a variety of forms. As an example, the sensor 12 may include an inner layer 16 and a protective layer 14 covering the inner layer 16 (shown in FIG. 1 only).

As discussed above, the inner layer 16 may be a pressure-sensitive film while the protective layer 14 may be a thermal insulating film. The protective layer 14 may provide a thermal barrier that is necessary in order for the film to survive the firing event. The thermal barrier protects against the heat and charring created from the propellant charges that are used during the launch of the projectile 10. Depending on the application where the projectile 10 is to be used, the sensor 12 may be formed of a single layer or multiple layers.

In addition, the sensor 12 may include a plurality of segments (see, e.g., segments 13, 15 in FIGS. 1, 2 and 8-10) that at least partially (or wholly) surround the casing 11. In some embodiments, the segments 13, 15, are separated from the casing 11 due to pressure that the projectile 10 is exposed to during launch. Even though the example sensor 12 is shown as being formed of two segments 13, 15, it should be noted that other embodiments are contemplated where the sensor 12 is formed of a single segment or more than two segments.

In the example embodiment illustrated in FIGS. 1-2 and 8-10, each segment 13, 15 of the sensor 12 includes edges 20A, 20B, 20C, 20D and the projectile 10 further includes a member 21 (see FIG. 2) that secures the sensor 12 to the casing 11 and covers the edges 20A, 20B, 20C, 20D of the segments 13, 15 that form the sensor 12.

In the example embodiment illustrated in FIG. 2, the member 21 includes sections 22A, 22B, 22C of tape that cover the edges 20A, 20B, 20C, 20D of the segments 13, 15 which form the sensor 12. The number of sections and type of member 21 that are utilized in the projectile 10 will depend in part on (i) the number of segments that are included in the sensor 12; and/or (ii) the type of sensor 12 that is utilized in the projectile 10 (among other factors).

Figure 8:
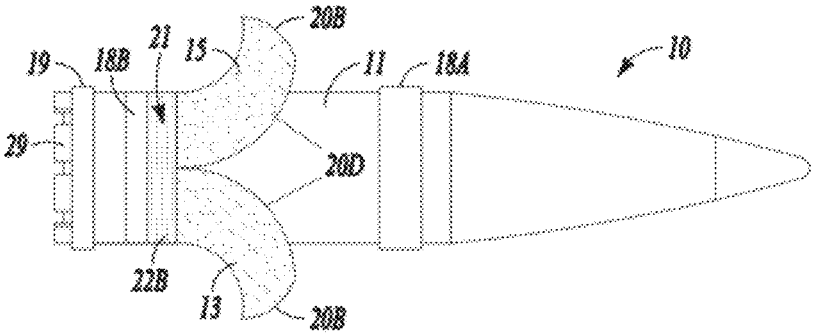
FIG. 8 illustrates another example projectile that includes a sensor which is secured to a casing of the projectile where the sensor is in the process of being removed from the casing.
Figure 9:
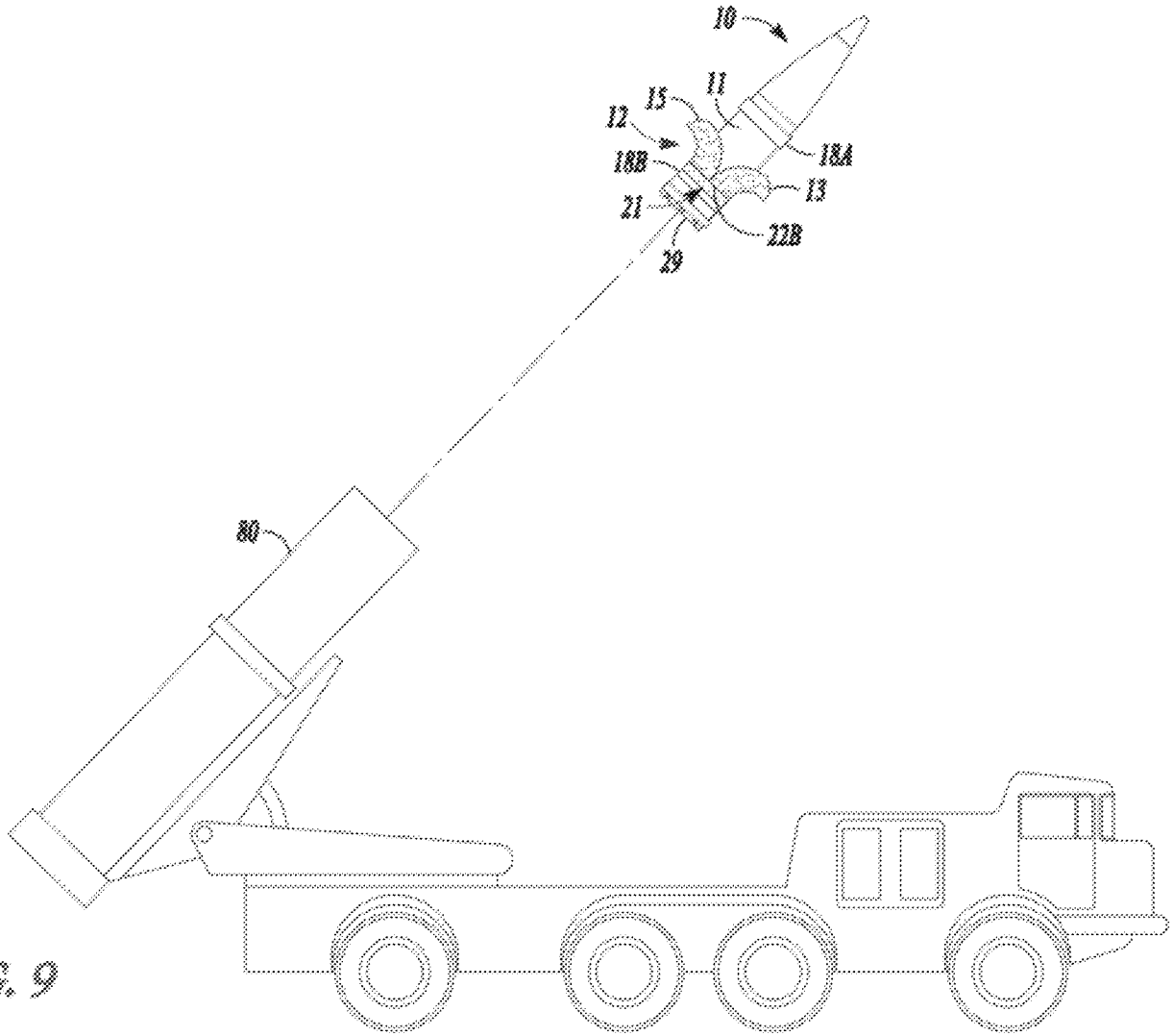
FIG. 9 illustrates the example projectile shown in FIG. 8 just after the projectile is launched from a cannon.
Figure 10:
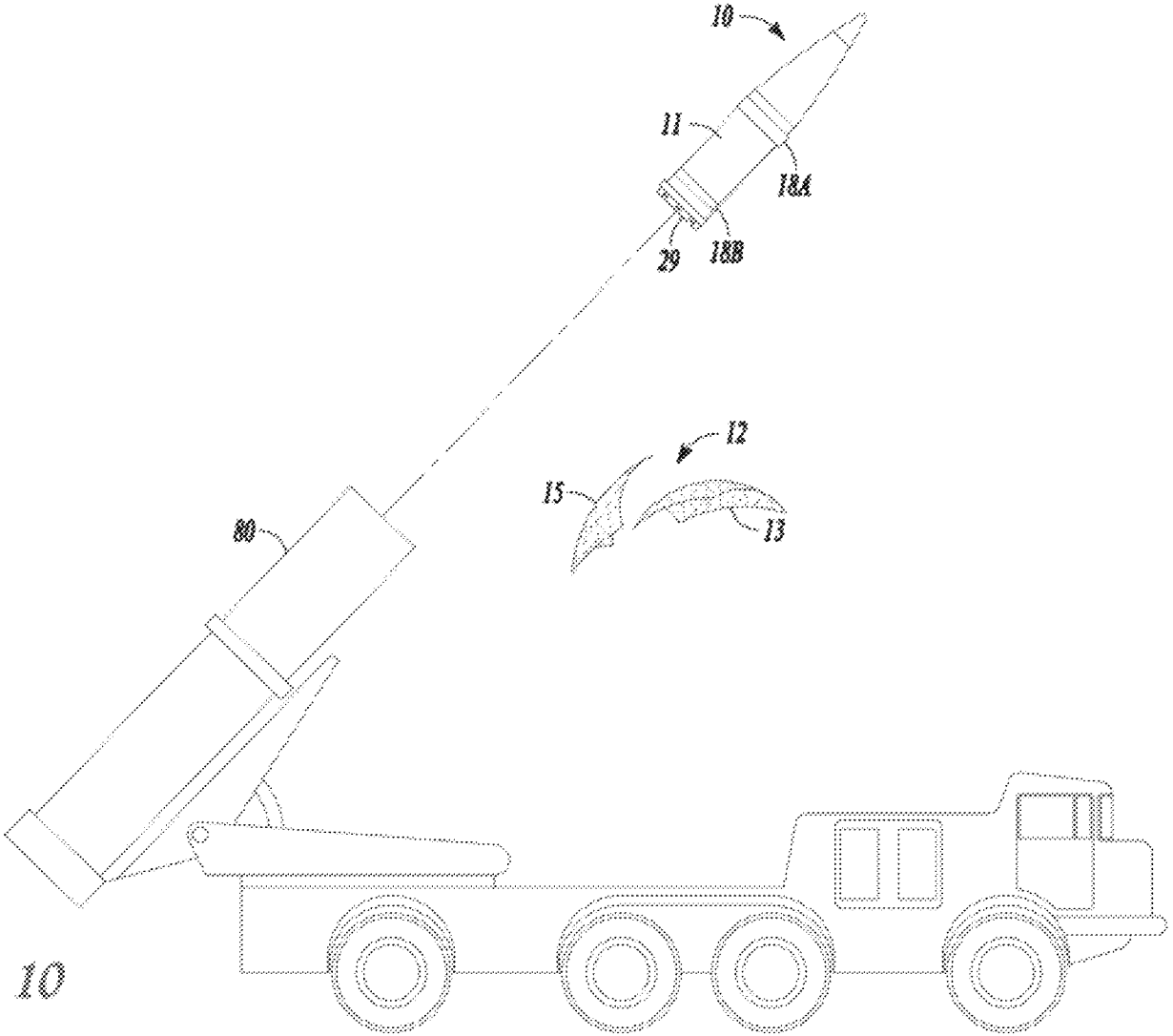
FIG. 10 is similar to FIG. 9 and illustrates the example projectile just after the sensor has fallen from the rest of the projectile.

As also shown in FIGS. 8-10, the combination of tape sections 22A, 22B, 22C that form member 21 and the segments 13, 15 that form sensor 12 enables a clean separation of the sensor 12 from the rest of the projectile 10 just after firing without undesired damage to the sensor 12. This ability to obtain an undamaged sensor 12 may be especially important when the sensor 12 includes a pressure sensitive film.

The tape sections 22A, 22B, 22C overlap the edges 20A, 20B, 20C, 20D of the segments 13, 15 in such a way as to create a clean line when the tape sections 22A, 22B, 22C are cut at the edges 20A, 20B, 20C, 20D from the pressure and heat during the firing. The tape sections 22A, 22B, 22C are cleanly cut because a pressure gradient is created as the projectile 10 travels through a cannon 80. The pressure gradient is large enough to create the clean cut of the tape sections 22A, 22B, 22C along the edges 20A, 20B, 20C, 20D of the segments 13, 15. As shown in FIGS. 9-10, once the tape sections 22A, 22B, 22C are cut, the two segments 13, 15 separate from the projectile 10 thereby enabling easy recovery of the segments 13, 15. The segments 13, 15 may then be used for post firing data analysis (see FIGS. 3-7).

The example projectiles described herein may provide the ability to adequately map the pressure (or other environmental data) that a projectile is exposed during launch and/or loading from a cannon. The sensor that is part of the projectile may also be readily retrieved for post firing analysis, especially when the sensor is a pressure-sensitive film that separates from the projectile just after firing from a cannon.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. A projectile comprising:

a casing; and a sensor that is separated from the casing due to pressure that the projectile is exposed to during launch, wherein the sensor obtains environmental data that the projectile is exposed to inside the cannon tube.

2. The projectile of claim 1 wherein the sensor is wrapped around the casing.

3. The projectile of claim 1 wherein the sensor obtains pressure data that the projectile is exposed to inside the cannon tube.

4. The projectile of claim 1 wherein the sensor includes edges and the projectile further comprises a member that secures the sensors to the casing and covers the edges of the sensor.

5. The projectile of claim 4 wherein the member includes tape that covers the edges of the sensor.

6. The projectile of claim 5 wherein the sensor includes a plurality of segments that at least partially surround the casing, each of the segments including edges that are covered by the tape.

7. The projectile of claim 1 wherein the sensor is includes an inner layer and a protective layer covering the inner layer.

8. The projectile of claim 7 wherein the inner layer is a pressure-sensitive film.

9. The projectile of claim 8 wherein the protective layer is a thermal insulating film.

10. A projectile comprising:

a casing; and a sensor that includes an inner layer and a protective layer covering the inner layer, the sensor being wrapped around the casing and is separated from the casing due to pressure that the projectile is exposed to during launch, wherein the sensor includes edges; and a member that secures the sensors to the casing and covers the edges of the sensor.

11. The projectile of claim 10 wherein the member includes tape that covers the edges of the sensor.

12. The projectile of claim 11 wherein the sensor includes a plurality of segments that at least partially surround the casing, each of the segments including edges that are covered by the tape.

13. The projectile of claim 10 wherein the inner layer is a pressure-sensitive film and the protective layer is a thermal insulating film.

* * * * *